United States Patent [19]

Brockett et al.

[11] Patent Number: 4,546,365

[45] Date of Patent: Oct. 8, 1985

[54] RECORD MEMBER

[75] Inventors: Bruce W. Brockett; Robert E. Miller, both of Appleton, Wis.

[73] Assignee: Appleton Papers Inc., Appleton, Wis.

[21] Appl. No.: 612,960

[22] Filed: May 23, 1984

[51] Int. Cl.[4] ..... B41M 5/16; B41M 5/22

[52] U.S. Cl. ..... 346/214; 346/216; 346/225; 427/150; 427/151

[58] Field of Search ..... 346/214, 216, 217, 225, 346/213, 226

[56] References Cited

U.S. PATENT DOCUMENTS 4,125,675 11/1978 Sekiguchi et al. ..... 346/214

4,199,619 4/1980 Oda et al. ..... 346/214

*Primary Examiner*—Bruce H. Hess

*Attorney, Agent, or Firm*—E. Frank McKinney; Paul S. Phillips, Jr.

[57] ABSTRACT

A record member comprising a developer composition comprising a glass comprising a biphenol color developer and a resinous material is disclosed. These compositions are particularly useful as color developers for basic chromogenic material.

24 Claims, No Drawings

RECORD MEMBER

This invention relates to the production of novel record material. More specifically, the invention involves sensitized record sheet material useful in developing dark-colored marks on contact with colorless solutions of basic chromogenic material (also called color formers). Such sheet material includes color developer material generally in the form of a coating on at least one sheet surface. The coating of color developer material serves as a receiving surface for colorless, liquid solutions of color formers which react, on contact, with the color developer material to produce the dark-colored marks.

Pressure-sensitive carbonless copy paper of the transfer type consists of multiple cooperating superimposed plies in the form of sheets of paper which have coated, on one surface of one such ply, pressure-rupturable microcapsules containing a solution of one or more color formers (hereinafter referred to as a CB sheet) for transfer to a second ply carrying a coating comprising one or more color developers (hereinafter referred to as a CF sheet). To the uncoated side of the CF sheet can also be applied pressure-rupturable microcapsules containing a solution of color formers resulting in a pressure-sensitive sheet which is coated on both the front and back sides (hereinafter referred to as a CFB sheet). When said plies are superimposed, one on the other, in such manner that the microcapsules of one ply are in proximity with the color developers of the second ply, the application of pressure, as by typewriter, sufficient to rupture the microcapsules, releases the solution of color former and transfers color former solution to the CF sheet resulting in image formation through reaction of the color former with the color developer. Such transfer systems and their preparation are disclosed in U.S. Pat. No. 2,730,456.

The use of certain biphenols as color developers in pressure-sensitive carbonless copy paper is disclosed in U.S. Pat. No. 3,244,550.

Japanese Patent Disclosure No. 50-150507 discloses a method of manufacturing a pressure-sensible reproduction paper coated with a micropowder composed of aromatic carboxylic acid and a synthetic high molecular substance dispersed in water in the presence of an alkali or ammonium salt of an alkyl sulfosuccinate.

U.S. Pat. No. 4,134,847 discloses a color developer obtained by heating a mixture of an aromatic carboxylic acid, a water-insoluble organic polymer and an oxide or carbonate of a polyvalent metal.

Japanese Patent Disclosure No. 57-080096 discloses a pressure-sensitive reproduction developer sheet containing a developer layer consisting of an aromatic carboxylic acid, a styrene polymer, a wax, and an activated clay.

Although certain biphenol compounds have been suggested for use as color developers in pressure-sensitive carbonless copy paper, the compounds suggested have failed to overcome certain existing problems in carbonless copy paper or have proven to have defects of their own which make them unattractive as color developers in commercial carbonless copy paper systems. The greatest single problem of many of the biphenol color developers previously suggested has been their failure to provide an adequately intense image under conditions of use in carbonless copy paper systems. The second greatest defect of these suggested biphenol developers has been that, even if they were utilized in carbonless copy paper systems in such a manner that an adequately intense image was obtained initially, this ability to continue to provide an adequately intense print was seriously reduced merely upon the natural aging of the coated sheet (hereinafter referred to as CF decline).

Among the existing problems in carbonless copy systems which the previously-suggested biphenol developers have failed to overcome is speed of image formation.

It is therefore an object of the present invention to provide a record member having improved image intensity, both initially and upon aging.

Another object of the present invention is to provide a record member having improved speed of image formation.

Yet another object of the present invention is to provide a record member comprising a substrate and a developer composition comprising a glass comprising a biphenol color developer and a resinous material.

In accordance with the present invention, it has been found that these and other objectives may be attained by employing a CF sheet which comprises a substrate coated with a composition comprising one or more glasses comprising one or more biphenol color developers and one or more resinous materials. The term glass refers to the more general definition of amorphous solids, formed by cooling of liquids, of any composition. The term biphenol refers to compounds containing two phenolic radicals, including diphenols and bisphenols. The term resinous materials refers to synthetic or natural resins which, when melted with the biphenol color developer, result in a homogenous, amorphous, noncrystalline composition. The resins can be, but are not required to be, color developers themselves. Exemplary of such resins, without implying limitation, are polystyrene, poly(alpha-methylstyrene), copolymers of vinyltoluene and alpha-methylstyrene and phenolic modified terpene resins.

The developer composition comprising a glass comprising a biphenol color developer and a resinous material can be utilized in either a transfer carbonless copy paper system as disclosed hereinbefore or in a self-contained carbonless copy paper system such as disclosed in U.S. Pat. Nos. 2,730,457 and 4,167,346. Many of both types of carbonless copy paper systems are exemplified in U.S. Pat. No. 3,672,935. Of the many possible arrangements of the mark-forming components in the transfer type of carbonless copy paper system, the most commonly employed is the one wherein the developer composition includes the color developer, one or more mineral materials and one or more binders. These compositions are then applied in the form of a wet slurry to the surface of what becomes the underlying ply (the CF sheet) in the carbonless copy paper system. Such CF sheet color developer composition coatings are disclosed in U.S. Pat. Nos. 3,455,721; 3,732,120; 4,166,644; and 4,188,456. Another useful arrangement of the developer composition is to prepare a sensitizing solution of the developer material and apply the solution to the nap fibers of sheet paper as disclosed in U.S. Pat. No. 3,466,184. A suitable alternative is to apply such a sensitizing solution of developer material to a base-coated sheet wherein the base coating comprises a pigment material. Examples of such pigment material include calcium carbonate, kaolin clay, calcined kaolin clay, etc. and mixtures thereof.

Examples of eligible color formers for use with the color developers of the present invention, to develop dark colored marks on contact, include, but are not limited to, Crystal Violet Lactone [3,3-bis(4-dimethylaminophenyl) -6-dimethylaminophthalide (U.S. Pat. No. Re. 23,024)]; phenyl-, indol-, pyrrol-, and carbazol-substitued phthalides (for example, in U.S. Pat. Nos. 3,491,111; 3,491,112; 3,491,116; 3,509,174); nitro-, amino-, amido-, sulfon amido-, aminobenzylidene-, halo-, anilino-substituted fluorans (for example, in U.S. Pat. Nos. 3,624,107; 3,627,787; 3,641,011; 3,642,828; 3,681,390); spirodipyrans (U.S. Pat. No. 3,971,808); and pyridine and pyrazine compounds (for example, in U.S. Pat. Nos. 3,775,424 and 3,853,869). Other specifically eligible chromogenic compounds, not limiting the invention in any way, are: 3-diethylamino-6-methyl-7-anilinofluoran (U.S. Pat. No. 3,681,390); 7-(1-ethyl-2-methylindol-3-yl)-7-(4-diethylamino -2-ethoxyphenyl)-5,7-dihydrofuro[3,4-b]pyridin-5-one (U.S. Pat. No. 4,246,318); 3-diethylamino-7-(2-chloroanilino)fluoran (U.S. Pat. No. 3,920,510); 3-(N-methylcyclohexylamino)-6-methyl-7-anilinofluoran (U.S. Pat. No. 3,959,571); 7-(1-octyl-2-methylindol-3-yl)-7-(4-diethylamino -2-ethoxyphenyl)-5,7-dihydrofuro[3,4-b]pyridin-5-one; 3-diethylamino-7,8-benzofluoran; 3,3-bis(1-ethyl-2-methylindol-3-yl)phthalide; 3-diethylamino-7-anilinofluoran; 3-diethylamino-7-benzylaminofluoran; 3'-phenyl-7-dibenzylamino-2,2'-spiro-di[2H-1-benzopyran]; and mixtures of any two or more of the above.

Preferred among the biphenols of the present invention are 4,4'-isopropylidenediphenol; 3,3-bis(-4-hydroxyphenyl)pentane; 2,2-bis(4-hydroxyphenyl) -4-methylpentane; 1,1-bis(4-hydroxyphenyl)cyclohexane; and bis(4-hydroxyphenyl)methane and preferred among the resinous materials of the present invention are polystyrene, poly(alpha-methylstyrene), copolymers of vinyltoluene and alpha-methylstyrene, indene resins and paracoumaroneindene resins.

The following examples are given merely as illustrative of the present invention and are not to be considered as limiting. All percentages and parts throughout the application are by weight unless otherwise specified.

The record member of this invention can be prepared as in the following series of steps. A mixture of biphenol color developer and a resin material is heated with stirring to a temperature sufficiently high to melt one or both components and produce a homogenous, amorphous composition. The composition is cooled to produce a glass. The developer composition glass is pulverized and the pulverized glass is mixed with water and one or more dispersing agents. The resulting mixture is ground in a particle size reducing apparatus, such as an attritor. The resulting developer composition glass grind is mixed with water and one or more binders to produce a coating composition. The coating composition, which can additionally contain one or more mineral materials such as, for example, kaolin clay, calcium carbonate titanium dioxide and calcined kaolin clay, is applied to a substrate, such as a paper web, and dried.

EXAMPLE 1

Using substantially the above-described procedure, a mixture of 5 parts of 4,4'-isopropylidenediphenol (Bisphenol A) and 95 parts of Kristalex 1120 [poly(alpha-methylstyrene) produced by Hercules Inc. of Wilmington, Del.] was heated to melting with stirring to produce a homogeneous, amorphous composition. The composition was allowed to cool and solidify overnight to a glass. The developer composition glass was crushed with a mortar and pestle and the developer composition glass particles were reduced in particle size by grinding the following composition for about 45 minutes in an attritor.

| Material | Parts, wet |
|---|---|
| developer composition glass | 50 |
| water | 45 |
| dispersant solution* | 5 |

*A 25% solution of the sodium salt of a carboxylate polyelectrolyte in water.

The developer composition glass was then mixed with a modified corn starch binder solution and a latex binder dispersion according to the following dry parts:

| Material | Parts, dry |
|---|---|
| developer composition glass grind | 78.3 |
| starch | 13.0 |
| latex | 8.7 |

Sufficient water was added to the above composition to produce a 25–30% solids mixture. This coating mixture was applied to a paper substrate with a #12 wire-wound coating rod and the coating was dried by the application of hot air.

EXAMPLE 2

The procedure of Example 1 was repeated except that the mixture of 5 parts Bisphenol A and 95 parts of poly(alpha-methylstyrene) was not melted. The unheated mixture was reduced in particle size in an attritor and the resulting grind was then formulated and coated as in Example 1.

EXAMPLE 3

The procedure of Example 1 was repeated except that in place of the mixture of Bisphenol A and poly(alpha-methylstyrene), poly(alpha-methylstyrene) alone was used.

EXAMPLES 4–19

In procedures substantially identical to those used in Examples 1–3, a variety of biphenol color developers and resinous materials, either in a glass or just in a mixture, and the resinuous materials alone were formulated into coating compositions, which were applied to paper substrates and dried. The resulting CF sheets were tested in a Typewriter Intensity (TI) test with CB sheets comprising a coating of the composition listed in Table 1, applied as an 18% solids dispersion applied to a paper base using a No. 12 wire-wound coating rod.

TABLE 1

| Material | % Dry |
|---|---|
| Microcapsules | 74.1% |
| Corn Starch Binder | 7.4% |
| Wheat Starch Particles | 18.5% |

The microcapsules employed contained the color former solution of Table 2 within capsule walls comprising synthetic resins produced by polymerization methods utilizing initial condensates as taught in U.S. Pat. No. 4,100,103.

TABLE 2

| Material | Parts |
|---|---|
| 7-(1-ethyl-2-methylindol-3-yl)-7-(4-diethylamino-2-ethoxyphenyl)-5,7-dihydrofuro[3,4-b]pyridin-5-one | 1.70 |
| $C_{10}$–$C_{13}$ alkylbenzene | 78.64 |
| sec-butylbiphenyl | 19.66 |

In the TI test a standard pattern is typed on a coated side-to-coated side CB-CF pair. After the image develops three hours, the intensity is measured by a reflectance method. The reflectance of the typed area is a measure of color development on the CF sheet and is reported as the ratio of the reflectance of the typed area to that of the background reflectance of the CF paper (I/Io), expressed as a percentage. A high value indicates little color development and a low value indicates good color development.

Listed in Table 3 are the resin type, the biphenol compound (if present), the composition type, the typewriter image reflectance intensity and the respective Example number.

From Table 3 it is readily apparent that developer compositions comprising a glass comprising a biphenol color developer and a resinous material provide surprisingly more intense images than do compositions comprising the same components not in glass form.

TABLE 3

| Example | Composition Components: Resin | Composition Components: Biphenol | Composition Type | Print Intensity I/Io (%) |
|---|---|---|---|---|
| 1. | poly(alpha-methylstyrene) | Bisphenol A | Glass | 56.1 |
| 2. | poly(alpha-methylstyrene) | Bisphenol A | Mix | 81.4 |
| 3. | poly(alpha-methylstyrene) | none | N.A.[1] | 93.7 |
| 4. | poly(alpha-methylstyrene) | 3,3-bis(4-hydroxyphenyl)pentane | Glass | 51.1 |
| 5. | poly(alpha-methylstyrene) | 3,3-bis(4-hydroxyphenyl)pentane | Mix | 85.0 |
| 6. | poly(alpha-methylstyrene) | 2,2-bis(4-hydroxyphenyl)-4-methylpentane | Glass | 50.6 |
| 7. | poly(alpha-methylstyrene) | 2,2-bis(4-hydroxyphenyl)-4-methylpentane | Mix | 78.7 |
| 8. | poly(alpha-methylstyrene) | 1,1-bis(4-hydroxyphenyl)-cyclohexane | Glass | 48.3 |
| 9. | poly(alpha-methylstyrene) | 1,1-bis(4-hydroxyphenyl)-cyclohexane | Mix | 80.4 |
| 10. | poly(alpha-methylstyrene) | bis(4-hydroxyphenyl)methane | Glass | 50.0 |
| 11. | poly(alpha-methylstyrene) | bis(4-hydroxyphenyl)methane | Mix | 85.6 |
| 12. | copolymer of vinyltoluene and alpha-methylstyrene | Bisphenol A | Glass | 47.8 |
| 13. | copolymer of vinyltoluene and alpha-methylstyrene | none | N.A.[1] | 96.0 |
| 14. | indene resin | Bisphenol A | Glass | 48.5 |
| 15. | indene resin | none | N.A.[1] | 96.6 |
| 16. | paracoumarone-indene resin | Bisphenol A | Glass | 52.1 |
| 17. | paracoumarone-indene resin | none | N.A.[1] | 97.1 |
| 18. | polystyrene | Bisphenol A | Glass | 55.8 |
| 19. | polystyrene | none | N.A.[1] | 93.9 |

[1]Not applicable because composition contains no biphenol color developer.

In order to determine the effect on speed of image formation produced by the glass developer composition of the present invention, Examples 6 and 7 were imaged in a TI test and the intensities of the resulting images were measured by a reflectance method at the following time intervals after imaging: immediately (within about 15–20 seconds); 10 minutes; 3 hours; and 24 hours. Each image intensity, determined as the ratio of the reflectance of the typed area to that of the background reflectance of the CF paper (I/Io) and expressed as a percentage, was converted to the Kubelka-Munk function in order to obtain the quantity of color in each image. Use of the Kubelka-Munk function as a means of determining the quantity of color present is discussed in TAPPI, *Paper Trade J.*, pages 31–38 (Dec. 21, 1939). The data obtained are entered in Table 4.

TABLE 4

| Example | Composition Type | Quantity of Color, Kubelka-Munk Function: Immediate | 10 min. | 3 Hours | 24 Hours |
|---|---|---|---|---|---|
| 6 | Glass | 0.0696 | 0.1205 | 0.1378 | 0.1360 |
| 7 | Mix | 0.0060 | 0.0109 | 0.0138 | 0.0138 |

Since the Kubelka-Munk function is an expression of the amount of color present it can be calculated that, for the glass, there was 51%, 89% and 100% of the untimate quantity of color available immediately and at 10 minutes and 3 hours, respectively. For the mix, the values are 43%, 79% and 100%, respectively. Thus, the rate of image development, or print speed, is unexpectedly greater for the glass than for the mix.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A record member comprising a substrate and a developer composition comprising a glass comprising a biphenol color developer and a resinous material.

2. The record member of claim 1 wherein the biphenol is selected from the group consisting of 4,4'-isopropylidenediphenol; 3,3-bis(4-hydroxyphenyl)pentane; 2,2-bis(4-hydroxyphenyl)-4-methylpentane; 1,1-bis(4-hydroxyphenyl)cyclohexane; and bis(4-hydroxyphenyl)methane.

3. The record member of claim 2 wherein the biphenol is selected from the group consisting of 3,3-bis(4-hydroxyphenyl)pentane; 1,1-bis(4-hydroxyphenyl)cyclohexane; and bis(4-hydroxyphenyl)methane.

4. The record member of claim 3 wherein the biphenol is bis(4-hydroxyphenyl)methane.

5. The record member of claim 1 wherein the resinous material is selected from the group consisting of polystyrene, poly(alpha-methylstyrene), a copolymer of vinyltoluene and alpha-methylstyrene, indene resin and paracoumarone-indene resin.

6. The record member of claim 5 wherein the resinous material is a copolymer of vinyltoluene and alpha-methylstyrene or indene resin.

7. A pressure-sensitive record unit comprising:

(a) support sheet material;

(b) mark-forming components, and a pressure-releasable liquid organic solvent for both said mark-forming components arranged in contiguous juxtaposition and supported by said sheet material;

(c) at least one of the mark-forming components being maintained in isolation from other mark-forming component(s);

(d) said mark-forming components comprising at least one basic chromogenic material and at least one glass comprising a biphenol color developer and a resinous material, which components, on pressure release of the liquid organic solvent, are brought into reactive contact.

8. The record unit of claim 7 wherein the biphenol is selected from the group consisting of 4,4'-isopropylidenediphenol; 3,3-bis(4-hydroxyphenyl)pentane; 2,2-bis(4-hydroxyphenyl)-4-methylpentane; 1,1-bis(4-hydroxyphenyl)-cyclohexane; and bis(4-hydroxyphenyl)methane.

9. The record unit of claim 8 wherein the biphenol is selected from the group consisting of 3,3bis(4-hydroxyphenyl)pentane; 1,1-bis(4-hydroxyphenyl)-cyclohexane; and bis(4-hydroxyphenyl)methane.

10. The record unit of claim 9 wherein the biphenol is bis(4-hydroxyphenyl)methane.

11. The record unit of claim 7 wherein the resinous material is selected from the group consisting of polystyrene, poly(alpha-methylstyrene), a copolymer of vinyltoluene and alpha-methylstyrene, indene resin and paracoumarone-indene resin.

12. The record unit of claim 11 wherein the resinous material is a copolymer of vinyltoluene and alpha-methylstyrene or indene resin.

13. A record member comprising a substrate and a developer composition comprising a glass comprising a biphenol color developer selected from the group consisting of 4,4'-isopropylidenediphenol; 3,3-bis(4-hydroxyphenyl)pentane; 2,2-bis(4-hydroxyphenyl)-4-methylpentane; 1,1-bis(4-hydroxyphenyl)cyclohexane; and bis(4-hydroxyphenyl)methane and a resinous material selected from the group consisting of polystyrene, poly(alpha-methylstyrene), a copolymer of vinyltoluene and alpha-methylstyrene, indene resin and paracoumarone-indene resin.

14. The record member of claim 13 wherein the biphenol is 3,3-(bis(4-hydroxyphenyl)pentane; 1,1-bis(4-hydroxyphenyl)cyclohexane; or bis(4-hydroxyphenyl)methane and the resinous material is a copolymer of vinyltoluene and alpha-methylstyrene or indene resin.

15. The record member of claim 14 wherein the biphenol is bis(4-hydroxyphenyl)methane and the resinous material is a copolymer of vinyltoluene and alpha-methylstyrene.

16. A record member comprising a substrate and a developer composition comprising a glass consisting essentially of a biphenol color developer and a resinous material.

17. The record member of claim 16 wherein the biphenol is selected from the group consisting of 4,4'-isopropylidenediphenol; 3,3-bis(4-hydroxyphenyl)pentane; 2,2-bis(4-hydroxyphenyl)-4-methylpentane; 1,1-bis(4-hydroxyphenyl)cyclohexane; and bis(4-hydroxyphenyl)methane.

18. The record member of claim 17 wherein the biphenol is selected from the group consisting of 3,3-bis(4-hydroxyphenyl)pentane; 1,1-bis(4-hydroxyphenyl) cyclohexane; and bis(4-hydroxyphenyl)methane.

19. The record member of claim 18 wherein the biphenol is bis(4-hydroxyphenyl)methane.

20. The record member of claim 16 wherein the resinous material is selected from the group consisting of polystyrene, poly(alpha-methylstyrene), a copolymer of vinyltoluene and alpha-methylstyrene, indene resin and paracoumarone-indene resin.

21. The record member of claim 20 wherein the resinous material is a copolymer of vinyltoluene and alpha-methylstyrene or indene resin.

22. A record member comprising a substrate and a developer composition comprising a glass consisting essentially of a biphenol color developer selected from the group consisting of 4,4'-isopropylidenediphenol; 3,3-bis(4-hydroxyphenyl)pentane; 2,2-bis(4-hydroxyphenyl)-4-methylpentane; 1,1-bis(4-hydroxyphenyl)cyclohexane; and bis(4-hydroxyphenyl)methane and a resinous material selected from the group consisting of polystyrene, poly(alpha-methylstyrene), copolymer of vinyltoluene and alpha-methylstyrene, indene resin and paracoumarone-indene resin.

23. The record member of claim 22 wherein the biphenol is 3,3-(bis(4-hydroxyphenyl)pentane; 1,1-bis(4-hydroxyphenyl)cyclohexane; or bis(4-hydroxyphenyl)methane and the resinous material is a copolymer of vinyltoluene and alpha-methylstyrene or indene resin.

24. The record member of claim 23 wherein the biphenol is bis(4-hydroxyphenyl)methane and the resinous material is a copolymer of vinyltoluene and alpha-methylstyrene.

* * * * *